United States Patent [19]

Matthews et al.

[11] Patent Number: 4,462,918

[45] Date of Patent: Jul. 31, 1984

[54] LUBRICATING OIL COMPOSITION

[75] Inventors: Peter H. D. Matthews, Tarvin; Derek W. Morecroft, Bromborough, both of England

[73] Assignee: Shell Oil Company, Houston, Tex.

[21] Appl. No.: 464,834

[22] Filed: Feb. 8, 1983

[30] Foreign Application Priority Data

Feb. 17, 1982 [GB] United Kingdom ..... 8204596

[51] Int. Cl.[3] ..... C10M 1/48; C10M 1/32

[52] U.S. Cl. ..... 252/32.7 E; 252/51.5 A; 252/51.5 R

[58] Field of Search ..... 252/32.7 E, 32.5, 51.5 A, 252/51.5 R

[56] References Cited

U.S. PATENT DOCUMENTS

| | | | |
|---|---|---|---|
| 3,427,245 | 2/1969 | Holten | 252/51.5 A |
| 3,983,098 | 9/1976 | Bussi et al. | 252/32.5 |
| 4,085,054 | 4/1978 | Bussi et al. | 252/32.5 |

*Primary Examiner*—Jacqueline V. Howard

[57] ABSTRACT

A lubricating oil composition is disclosed which comprises a major proportion of a lubricating oil and a minor proportion of each of a Group II metal dithiophosphate and composition having the formula

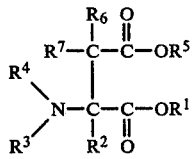

wherein $R^1$, $R^2$, $R^5$, $R^6$ and $R^7$ each are hydrogen or hydrocarbon containing 1–30 carbon atoms, and wherein $R^3$ and $R^4$ are independently selected from hydrogen, hydrocarbon containing from 1 to 30 carbon atoms, and acyl containing from 1 to 30 carbon atoms.

7 Claims, No Drawings

LUBRICATING OIL COMPOSITION

BACKGROUND OF THE INVENTION

The invention relates to a lubricating oil composition, and in particular to a lubricating oil composition which may be used as a hydraulic fluid.

Hydraulic fluids are used for the transmission of power and control in the hydraulic systems of industrial equipment, e.g., presses, and machine tools, earth moving equipment, and marine equipment such as ship stearing gear. Above all, a hydraulic fluid should be relatively incompressible and sufficiently fluid to permit efficient transmission of power. Moreover, a hydraulic fluid must possess good lubricating properties for the pumps, bearings, etc., in the system, and should also provide good protection against corrosion, rust and wear. Accordingly, much effort has been expended in finding and improving hydraulic fluids which will meet each of these requirements.

Normally, hydraulic fluids comprise a major proportion of a base material like a lubricating oil and minor proportions of additives which possess specific properties, such as demulsifying agents, antioxidants, pourpoint depressants, anti-foam agents, VI-improvers, and additives which inhibit the rusting and corrosion of metal parts of a hydraulic system. The invention relates to such compositions.

SUMMARY OF THE INVENTION

Accordingly, the invention provides a lubricating oil composition comprising a major proportion of a lubricating oil and a minor proportion of each of a Group II metal dithiophosphate and a composition having the formula

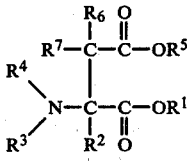

wherein $R^1$, $R^2$, $R^5$, $R^6$ and $R^7$ are hydrogen or hydrocarbon containing 1 to 30 carbon atoms, and wherein $R^3$ and $R^4$ are independently selected from hydrogen, hydrocarbon containing from 1 to 30 carbon atoms, and acyl containing from 1 to 30 carbon atoms.

The combination of the Group II metal dithiophosphate anti-wear additive with the esters of the class of aminosuccinic acids used as anti-rust agents in lubricating oil compositions which can be used as hydraulic oils leads to a much better anti-wear performance of the lubricating oil composition that can be achieved with the known anti-wear additives above. $R^1$, $R^2$, $R^3$, $R^4$, $R^5$, $R^6$ and $R^7$ may also be selected from the group consisting of cycloalkyl, or aromatic containing groups. Preferably, $R^1$ and $R^5$ are the same or different straight-chain or branched-chain hydrocarbon radicals containing 1-20 carbon atoms. Most preferably, $R^1$ and $R^5$ are saturated hydrocarbon radicals containing 3-6 carbon atoms. $R^2$, either $R^3$ or $R^4$, $R^6$ and $R^7$ are preferably the same or different straight-chain or branched-chain saturated hydrocarbon radicals. Preferably a dialkylester of an aminosuccinic acid is used which $R^1$ and $R^5$ are the same or different alkylgroups containing 3-6 carbon atoms, $R^2$ is hydrogen, either $R^3$ or $R^4$ is an alkylgroup contaning 15-20 carbon atoms or an acyl group which is derived from a saturated or unsaturated carboxylic acid containing 2-10 carbon atoms.

Most preferred is a dialkylester of an aminosuccinic acid of said formula in which $R^1$ and $R^5$ are isobutyl, $R^2$ is hydrogen, $R^3$ is octadecyl and/or octadecenyl and $R^4$ is 3-carboxy-1-oxo-2-propenyl.

The metal dithiophosphate which may be used according to the invention is preferably a commercially available Group II metal dialkyl dithiophosphate of which the Group II metal is preferably selected from the group consisting of Zn, Mg, Ca and Ba. Most preferably, the Group II metal dialkyl dithiophosphate is a zinc dialkyl dithiophosphate of which the alkylgroups contain 3-20 carbon atoms. Alkoxylated metal dithiophosphates, e.g., those which are known from U.K. Pat. No. 8,006,268, may also be used in the lubricating oil composition according to the invention.

The lubricating oil composition according to the invention comprises preferably from 0.1-5 percent by weight of said Group II metal dithiophosphate and from 0.01-5 percent by weight of a dialkylester of an aminosuccinic acid. Most preferably, the lubricating oil composition according to the invention compriss from 0.1-1.5 percent by weight of said Group II metal dithiophosphate and from 0.01-1.5 percent by weight of said dialkylester of an aminosuccinic acid.

The lubricating oil may have been prepared from a crude mineral oil by means of physical separation methods, such as distillation, de-asphalting and dewaxing, or it may have been prepared by means of chemical conversion such as catalytic or non-catalytic hydrotreatment of mineral oil fractions, or by a combination of physical separation methods and chemical conversion, or it may be a synthetic hydrocarbon base oil. Preferably, the lubricating oil has a kinematic viscosity of from 5-220 cSt at 40° C.

The present combination of additives may suitably be used with other additives such as pourpoint depressants and VI-improvers like polymethacrylate, and anti-foam agents which are normally silicone based, and demulsifiers.

DETAILED DESCRIPTION OF THE INVENTION

The invention will now be illustrated with reference to the following Examples.

EXAMPLE I

To investigate the anti-wear performance of the lubricating oil composition according to the invention, the steel-on-steel anti-wear performance of this lubricating oil composition was tested in the Vickers Vane V 104 C pump test of the Institute of Petroleum, known under the code name IP 281. For this test, a base oil was used which is derived from a paraffinic crude oil having a kinematic viscosity at 40° C. of 37 cSt. The metal dithiophosphate was a zinc dialkyl dithiophosphate commercially available as "Lubrizol*677A" (compound A) and the dialkylester of aminosuccinic acid was a commercially available anti-rust agent-viz. aspartic acid, N-(3-carboxy-1-oxo-2-propenyl)-N-octadecyl-bis-(2-methylpropyl) ester (compound B). As a comparison, the same oil containing only compound A was also tested.

*Lubrizol is a registered trademark in the name of Lubrizol Corporation U.S.A.

Table I gives the results of this test.

TABLE I

| Test sample | Wear rate of components according to IP 281 (measured weight loss of rlng + vanes) |
|---|---|
| base oil + 0.37% w compound A | 152 mg |
| base oil + 0.1% w compound B + 0.37% w compound A | <20 mg |

The effect of the combination of anti-wear agent (compound A) and anti-rust agent (compound B) is clearly represented in the significantly lower wear rate of components of the Vickers Vane pump test.

EXAMPLE II

In another test, the influence of the combination of compound A and compound B in the lubrication oil composition according to the invention on the wear rates of phosphor bronze and brass components in contact with steel in hydraulic pumps was investigated. For this purpose, the Amsler rig test was used. In this test, a specimen of phosphor bronze or brass of the type used in hydraulic piston pumps was fixed in a stationary holder and was in contact under a constant applied load with a rotating steel disc. The lubricant under test was applied by a jet to the contact zone. The potential of the fluid under test to reduce the wear rate of the fixed phosphor bronze or brass test specimen when in contact with steel was assessed by measurement of the rate of decrease in length of the specimen with time and is expressed in micrometers per hour.

For this test, the same base oil as in the test of Example I was used.

Table II gives the results of this test.

TABLE II

| Test sample | wear rate*, steel-on- phosphor bronze | brass |
|---|---|---|
| base oil + 0.37% w compound A | 120.0 | 22.9 |
| base oil + 0.1% w compound B + 0.37% w compound A | 23.5 | 2.5 |

*wear rate is expressed in a reduction of length of test material in contact with a rotating steel disc ($\mu m\ hour^{-1}$).

What is claimed is:

1. A lubricating oil composition comprising a major proportion of a lubricating oil and from 0.1 to 5 percent by weight of a Group II metal dithiophosphate and from 0.01 to 5 percent by weight of a compound having the formula

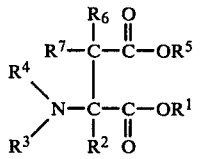

wherein $R^1$, $R^2$, $R^5$, $R^6$ and $R^7$ each are hydrogen or hydrocarbon containing 1 to 30 carbon atoms, and wherein $R^3$ and $R^4$ are independently selected from hydrogen, hydrocarbon containing from 1 to 30 carbon atoms, and acyl containing from 1 to 30 carbon atoms.

2. The composition of claim 1 in which $R^1$ and $R^5$ are the same or different straight-chain or branched-chain hydrocarbon containing 1–20 carbon atoms.

3. The composition of claim 2 in which $R^1$ and $R^5$ are saturated hydrocarbon containing 3 to 6 carbon atoms.

4. The composition of claim 1 in which $R^1$ and $R^5$ are the same or different alkyl containing 3 to 6 carbon atoms, $R^2$ is hydrogen, and $R^3$ and $R^4$ are independently selected from alkyl containing 15 to 20 carbon atoms or saturated or unsaturated acyl containing 2 to 10 carbon atoms.

5. The composition of claim 3 in which $R^1$ and $R^5$ are isobutyl, $R^2$ is hydrogen, $R^3$ is octadecyl, and $R^4$ is 3-carboxy-1-oxo-2-propenyl.

6. The composition of claims 1 through 5 in which the Group II metal dithiophosphate is a Group II metal dialkyl dithiophosphate in which the metal is selected from the group consisting of Zn, Mg, Ca and Ba.

7. The composition of claims 1 through 5 in which the Group II metal dithiophosphate is a zinc dialkyl dithiophosphate in which the alkyl groups contain 3–20 carbon atoms.

* * * * *